US009986825B1

(12) United States Patent
Lin

(10) Patent No.: US 9,986,825 B1
(45) Date of Patent: Jun. 5, 2018

(54) ASSEMBLY STORAGE RACK

(71) Applicant: THN SHONG INDUSTRIAL CO., LTD., Taichung (TW)

(72) Inventor: Tsong-Yow Lin, Taichung (TW)

(73) Assignee: THN SHONG INDUSTRIAL CO., LTD., Taichung (TW)

( * ) Notice: Subject to any disclaimer, the term of this patent is extended or adjusted under 35 U.S.C. 154(b) by 0 days. days.

(21) Appl. No.: 15/494,596

(22) Filed: Apr. 24, 2017

(51) Int. Cl.
*A47B 88/00* (2017.01)
*A47B 47/00* (2006.01)
*A47B 88/40* (2017.01)

(52) U.S. Cl.
CPC ..... *A47B 47/0083* (2013.01); *A47B 88/40* (2017.01); *A47B 2210/08* (2013.01)

(58) Field of Classification Search
CPC ... A47B 47/0083; A47B 47/045; A47B 88/40; A47B 88/402; A47B 88/407; A47B 96/16
See application file for complete search history.

(56) References Cited

U.S. PATENT DOCUMENTS 8,960,822 B1 * 2/2015 Hsu ..... A47B 88/16 312/334.4
9,493,177 B1 * 11/2016 Chen ..... B62B 3/005
2004/0089625 A1 * 5/2004 Tsai ..... A47F 5/108 211/126.2
2008/0246377 A1 * 10/2008 Huang ..... A47B 55/00 312/334.8
2009/0020528 A1 * 1/2009 Chang ..... A47B 47/0083 220/4.27
2017/0215579 A1 * 8/2017 Cooper ..... A47B 47/0083

* cited by examiner

*Primary Examiner* — Daniel J Rohrhoff
(74) *Attorney, Agent, or Firm* — Alan D. Kamrath; Kamrath IP Lawfirm, P.A.

(57) ABSTRACT

An assembly storage rack includes two pair of support legs, two rail members, and a plurality of drawers. Each rail member includes a pair of connection portions and a plurality of rail portions. The pair of connection portions and the plurality of rail portions are integrally formed with each other. The pair of connection portions and the plurality of rail portions are respectively formed at two opposite sides of each rail member. The pair of connection portions of each rail member is detachedly mounted to each pair of support legs. Each drawer is slidably mounted between two rail portions of the two rail members facing each other.

14 Claims, 6 Drawing Sheets

--Prior Art--

ASSEMBLY STORAGE RACK

BACKGROUND OF THE INVENTION

The present invention relates to units for storage and, particularly, to an improved assembly storage rack.

FIG. 6 shows a rack 90 including two pairs of support legs 91, a plurality of rail members 92, and a plurality of drawers 93. The support legs 91 are curved metal columns and face each other. The rail members 92 are welded between each pair of support legs 91 and are separated from each other at longitudinal equidistant intervals. Each drawer 93 is slidably mounted between each two rail members 92 facing each other.

For aesthetics, the support legs 91 and the rail members 92 are usually electroplated first, and then are welded to each other. However, welding traces will be inevitably formed between the support legs 91 and the rail members 92 due to the curved outer periphery of the support leg 91, affecting the appearance aesthetics.

Further, each of the rail members 92 must be manufactured individually and is individually welded to the support legs 91 to cause a complex manufacturing process.

The volume of rack 90 cannot reduce due to the support legs 91 and the rail members 92 weldedly connected with each other, leading to higher warehouse cost and transportation cost.

The present invention is, therefore, intended to obviate or at least alleviate the problems encountered in the prior art.

BRIEF SUMMARY OF THE INVENTION

An assembly storage rack includes two pair of support legs, two rail members, and a plurality of drawers. Each rail member includes a pair of connection portions and a plurality of rail portions. The pair of connection portions and the plurality of rail portions are integrally formed with each other. The pair of connection portions and the plurality of rail portions are respectively formed at two opposite sides of each rail member. The pair of connection portions of each rail member is detachedly mounted to each pair of support legs. Each drawer is slidably mounted between two rail portions of the two rail members facing each other.

Each rail member may be formed by an injection molding process.

Each rail member may be made of plastic.

Moreover, the pair of connection portions of each rail member has a pair of connection slots abutable against outer peripheries of each pair of support legs.

Each connection slot may have an arc-shaped slot-face.

The pair of connection portions of each rail member is threadedly connected to each pair of support legs.

In an example, each pair of support legs is straight metal cylinders extending along longitudinal straight lines. The pair of connection portions of each rail member extends along the longitudinal straight lines to correspond to each pair of support legs.

In another example, each pair of support legs is curved metal cylinders extending along longitudinal curved lines. The pair of connection portions of each rail member extends along the longitudinal curved lines to correspond to each pair of support legs.

The assembly storage rack further includes a pair of support rods threadedly mounted between top ends of the two pair of support legs, and a cap member detachedly mounted on the pair of support rods.

Each rail portion has a sliding recess extending therethrough. Each drawer includes a pair of guiding portions formed at two opposite sides thereof. The pair of guiding portions of each drawer is slidably mounted in two sliding recesses of two rail portions of the two rail members facing each other.

The present invention will become clearer in light of the following detailed description of illustrative embodiments of this invention described in connection with the drawings.

DETAILED DESCRIPTION OF THE INVENTION

Figure 1:
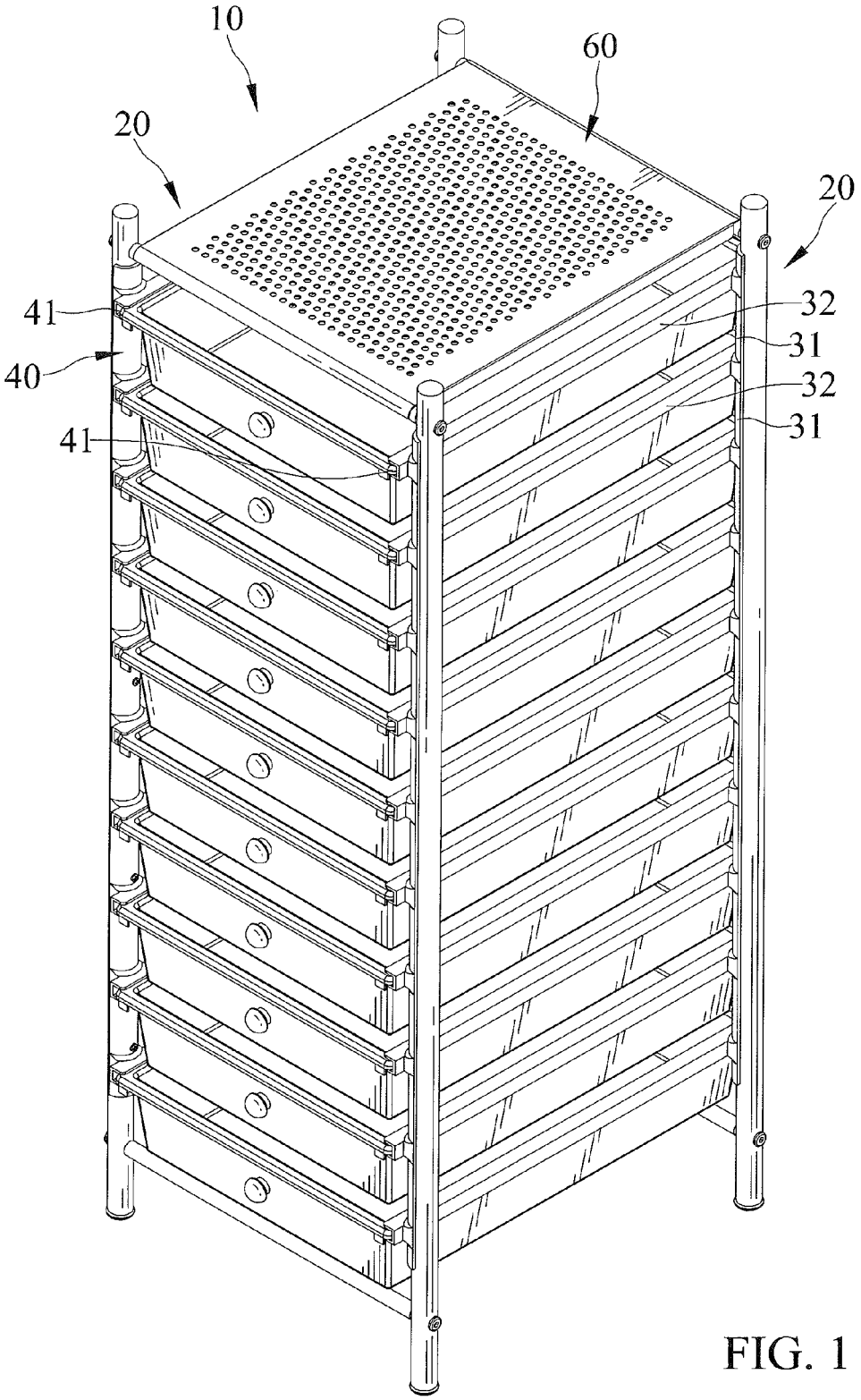
FIG. 1 is a perspective view of an assembly storage rack of a first embodiment according to the present invention.
Figure 2:
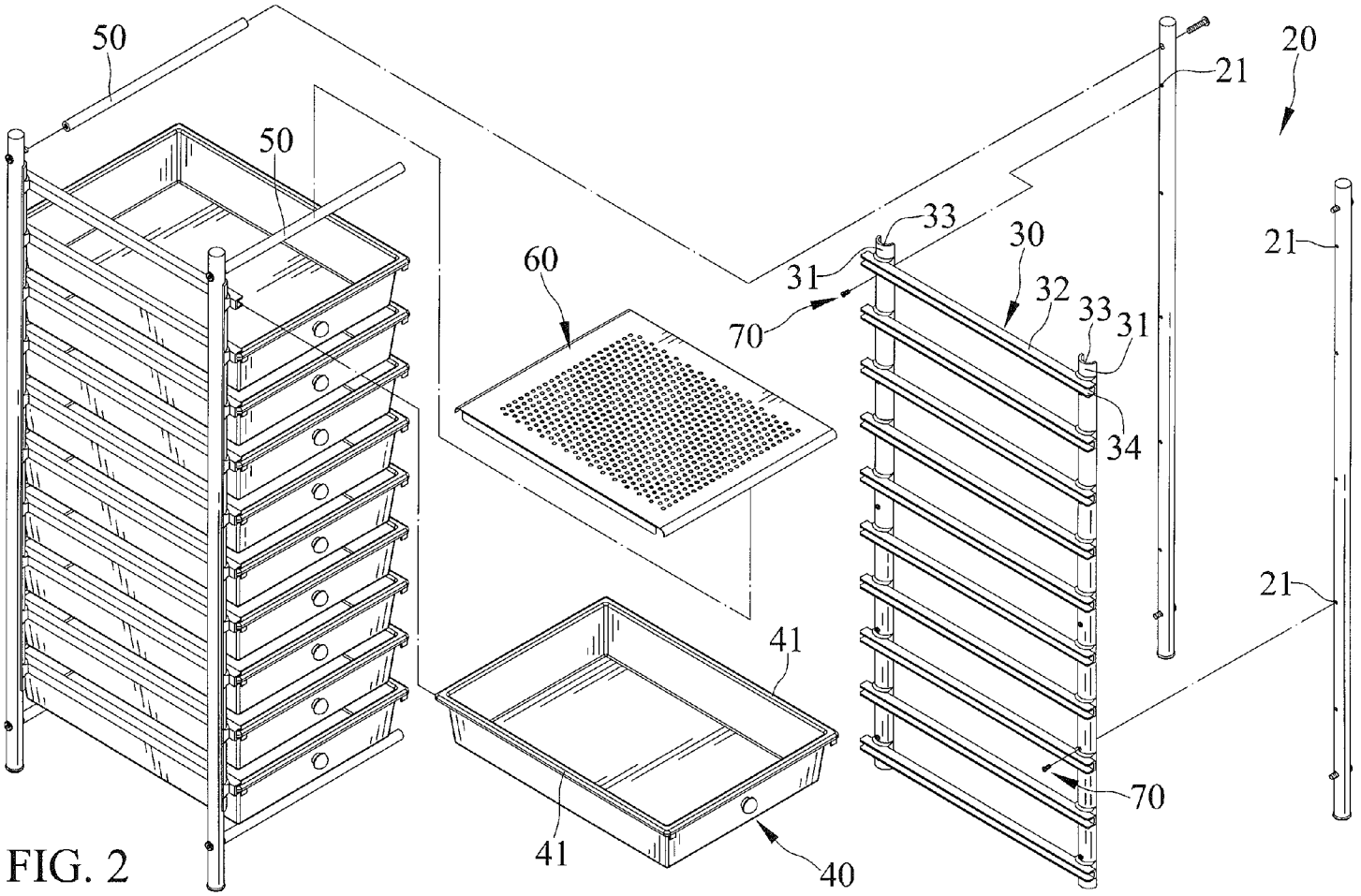
FIG. 2 is an exploded perspective view of the assembly storage rack of FIG. 1.
Figure 3:
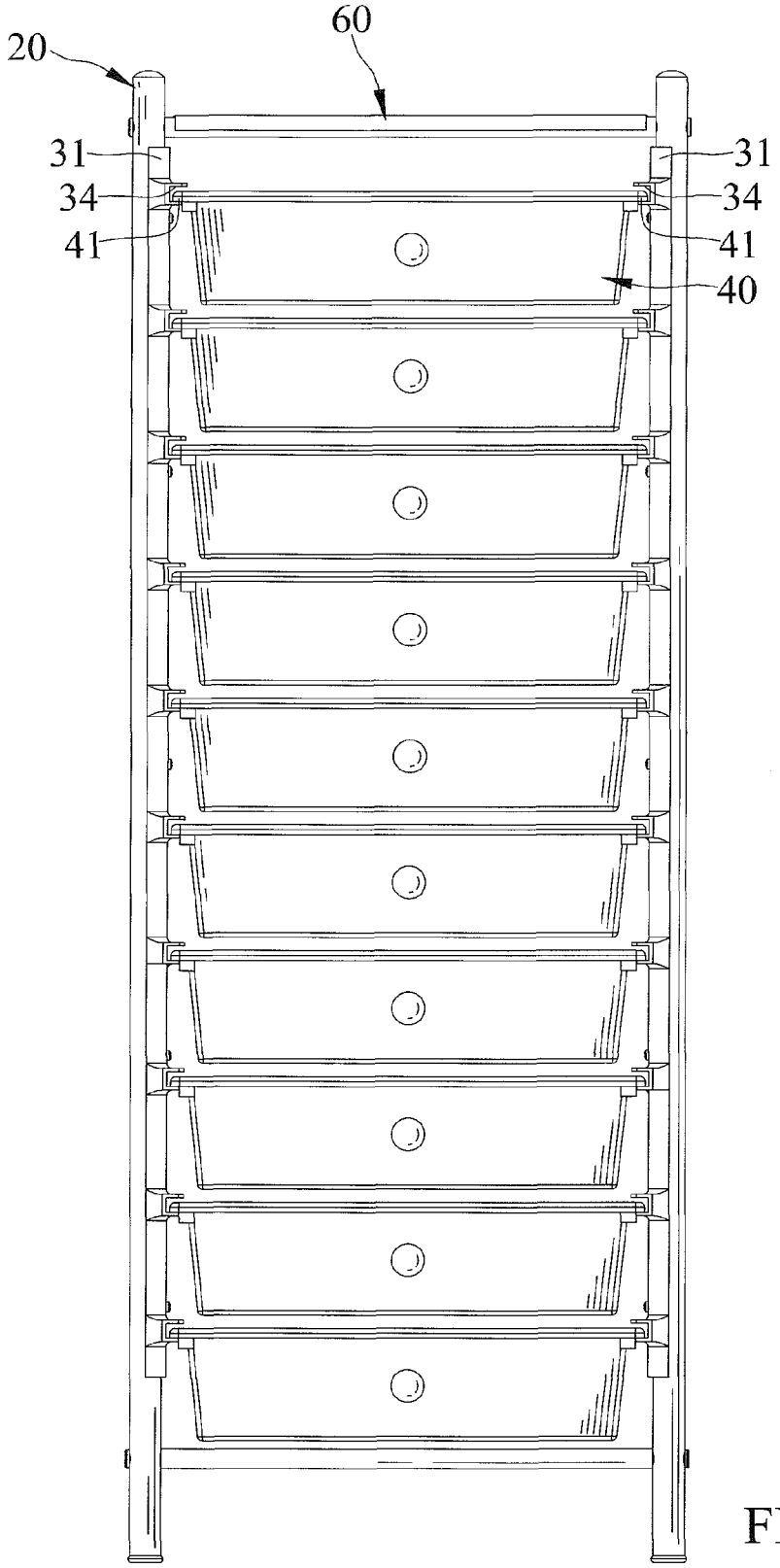
FIG. 3 is a front view of the assembly storage rack of FIG. 1.
Figure 4:
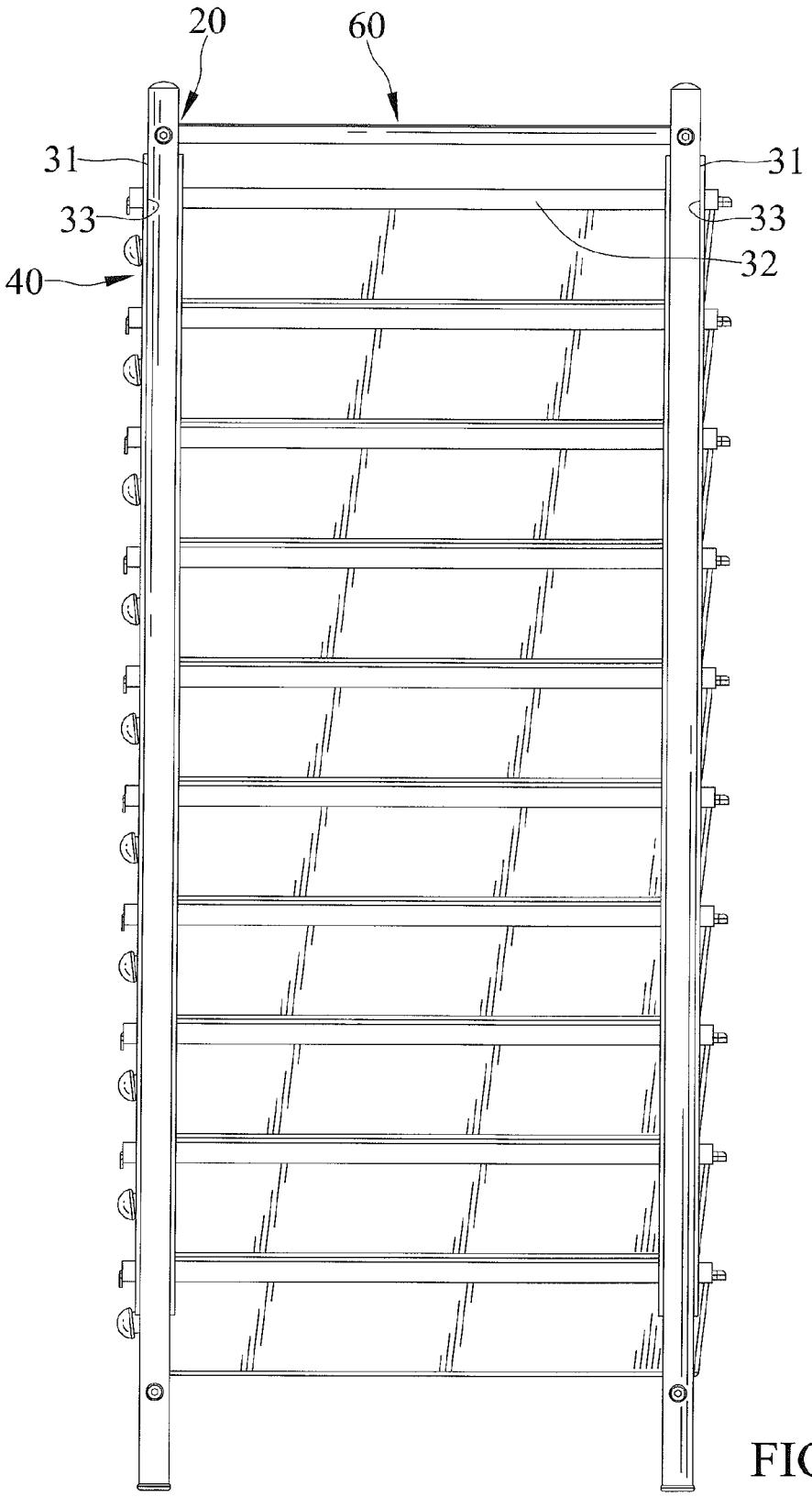
FIG. 4 is a side view of the assembly storage rack of FIG. 1.

FIGS. 1-5 show an assembly storage rack 10 of a first embodiment according to the present invention. The assembly storage rack 10 includes two pair of support legs 20, two rail members 30 each detachedly connected to each pair of support legs 20, a plurality of drawers 40 each slidably mounted between the two rail members 30, a pair of support rods 50 detachedly connected to the two pair of support legs 20, a cap member 60 detachedly mounted on the pair of support rods 50, and a plurality of threaded member 70.

Each pair of support legs 20 may be straight metal cylinders extending along longitudinal straight lines, and includes a plurality of threaded holes 21.

Each rail member 30 is made of plastic and is formed by an injection molding process. Thus, the two rail members 30 are designed in a modular way to reduce the manufacturing cost. Each rail member 30 includes a pair of connection portions 31 and a plurality of rail portions 32. The pair of connection portions 31 and the plurality of rail portions 32 are integrally formed with each other to reduce assembly time and manufacturing steps. The pair of connection portions 31 and the plurality of rail portions 32 are respectively formed at two opposite sides of each rail member 30. The pair of connection portions 31 extends along the longitudinal straight lines to correspond to each pair of support legs 20. The pair of connection portions 31 is detachedly mounted to each pair of support legs 20. Further, the pair of connection portions 31 may be threadedly mounted to each pair of support legs 20 to reduce the storage volume. The pair of connection portions 31 has a pair of connection slots 33 each having an arc-shaped slot-face abutable against outer peripheries of each pair of support legs 20. The plurality of rail portions 32 is parallel to each other and is equally spaced from each other longitudinally. Each rail portion 32 has a sliding recess 34 horizontally extending therethrough.

Each drawer 40 includes a pair of guiding portions 41 formed at two opposite sides thereof. The pair of guiding portions 41 is slidably mounted in two sliding recesses 34 of two rail portions 32 of the two rail members 30 facing each other.

The pair of support rods 50 is threadedly mounted between top ends of the two pair of support legs 20.

The cap member 60 is detachedly mounted on the pair of support rods 50 and may be used for placing commodities.

The plurality of threaded member 70 extends through the pair of connection portions 31 of each rail member 30, and then engages into the plurality of threaded holes 21 of each pair of support legs 20 to cause the pair of connection portions 31 to be threadedly mounted to each pair of support legs 20.

Figure 5:
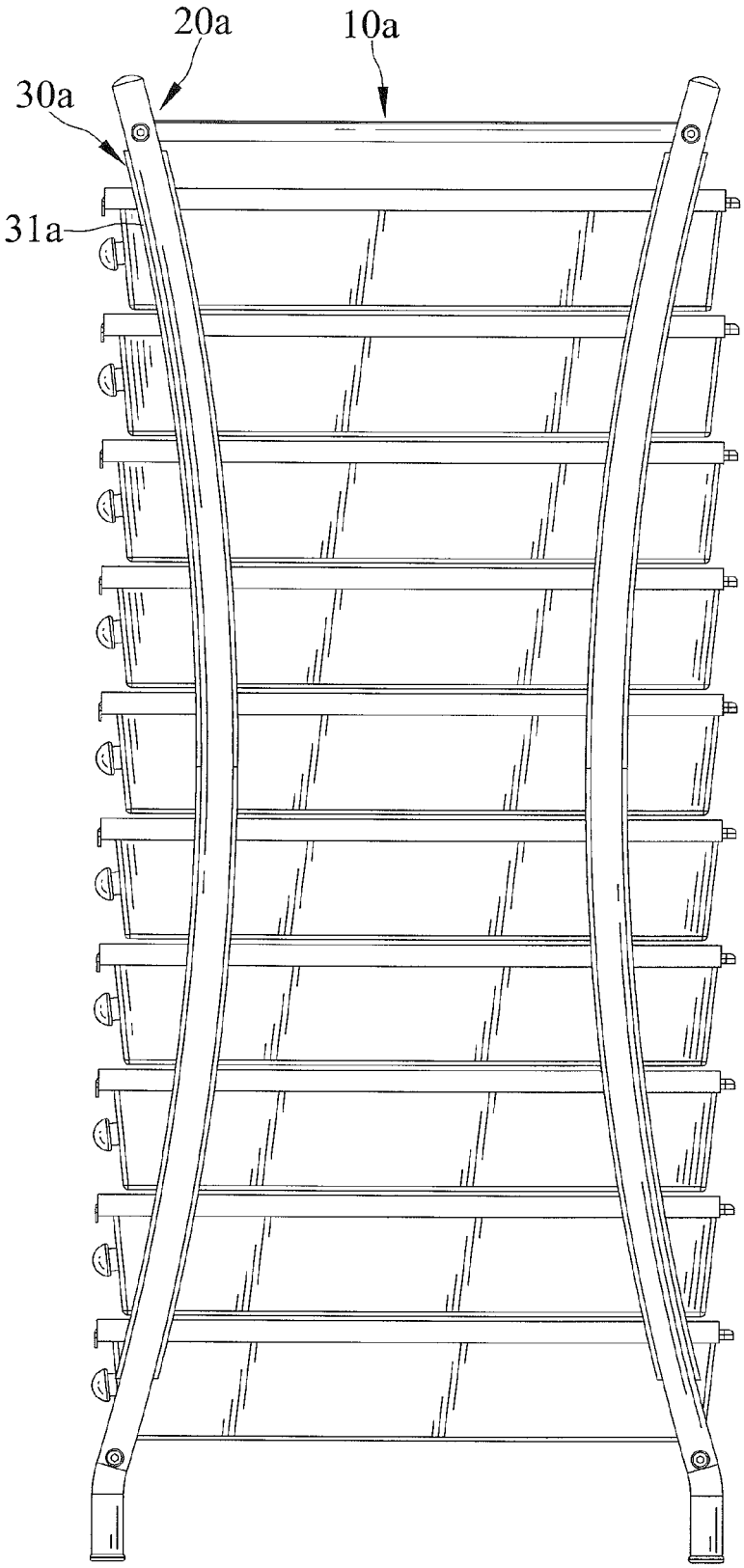
FIG. 5 is a side view of an assembly storage rack of a second embodiment according to the present invention.
Figure 6:
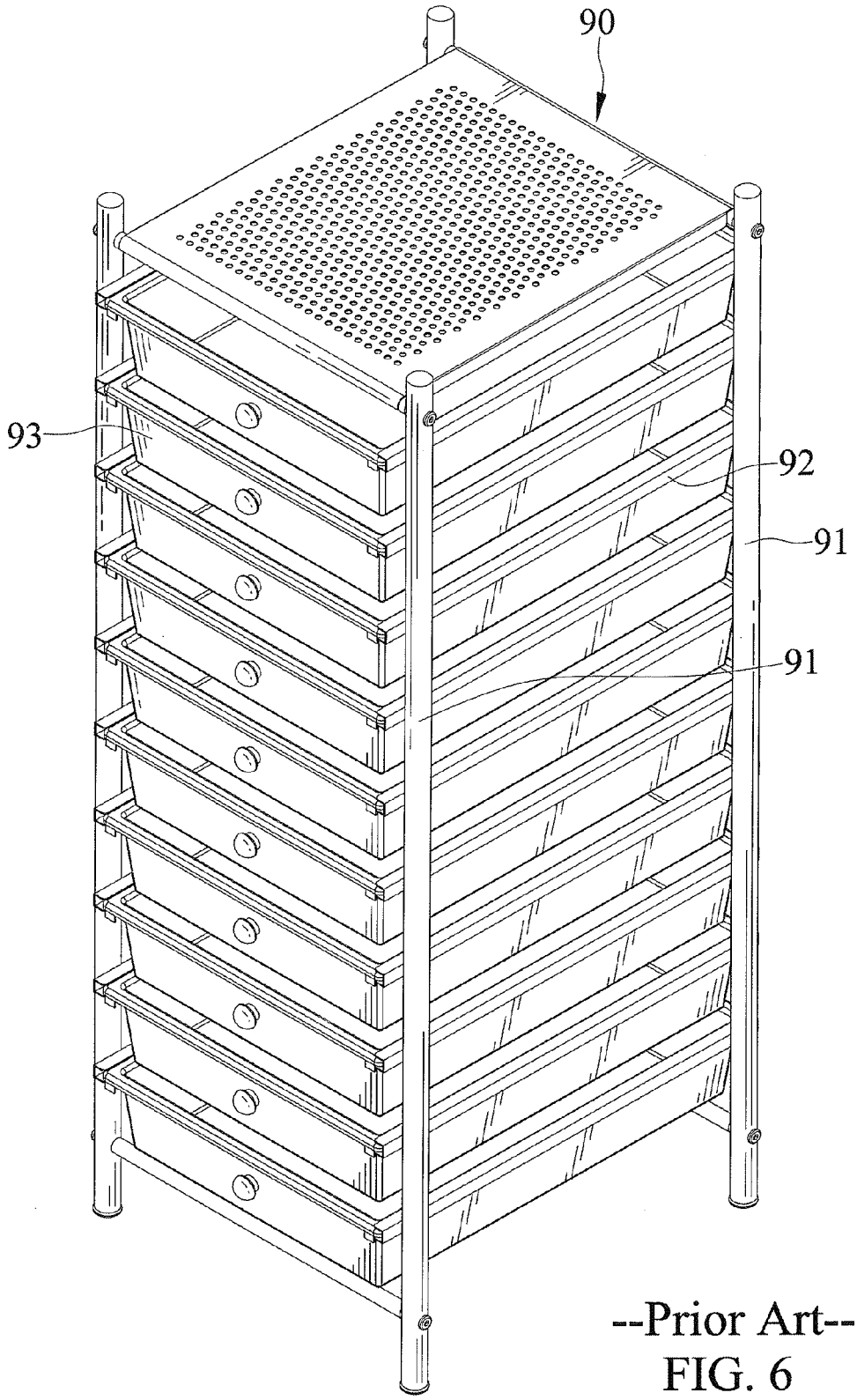
FIG. 6 is a perspective view of a conventional rack.

FIG. 5 shows an assembly storage rack 10*a* in accordance with a second embodiment of the present invention. The second embodiment is generally similar to the first embodiment except that each pair of support legs 20*a* may be metal cylinders extending along longitudinal curved lines. The pair of connection portions 31*a* of each rail member 30*a* extending along the longitudinal curved lines correspond to each pair of support legs 20*a*.

Although specific embodiments have been illustrated and described, numerous modifications and variations are still possible without departing from the scope of the invention. The scope of the invention is limited by the accompanying claims.

The invention claimed is:

1. An assembly storage rack comprising:

two pair of support legs extending along longitudinal straight lines;

two rail members each including a pair of connection portions and a plurality of rail portions, with the pair of connection portions and the plurality of rail portions being integrally formed with each other, with the pair of connection portions and the plurality of rail portions respectively formed at two opposite sides of each rail member, with the pair of connection portions of each rail member extending along the longitudinal straight lines to correspond to each pair of support legs, with the pair of connection portions of each rail member threadedly mounted to each pair of support legs; and a plurality of drawers each slidably mounted between two rail portions of the two rail members facing each other.

2. The assembly storage rack as claimed in claim 1, with each rail member formed by an injection molding process.

3. The assembly storage rack as claimed in claim 2, with each rail member being made of plastic.

4. The assembly storage rack as claimed in claim 3, with the pair of connection portions of each rail member having a pair of connection slots abutable against outer peripheries of each pair of support legs.

5. The assembly storage rack as claimed in claim 4, with each connection slot having an arc-shaped slot-face.

6. The assembly storage rack as claimed in claim 1, with each pair of support legs being straight metal cylinders.

7. The assembly storage rack as claimed in claim 1, further comprising:

a pair of support rods threadedly mounted between top ends of the two pair of support legs; and a cap member detachedly mounted on the pair of support rods.

8. The assembly storage rack as claimed in claim 1, with each rail portion having a sliding recess extending therethrough, with each drawer including a pair of guiding portions formed at two opposite thereof, and with the pair of guiding portions of each drawer slidably mounted in two sliding recesses of two rail portions of the two rail members facing each other.

9. An assembly storage rack comprising:

two pair of support legs extending along longitudinal curved lines;

two rail members each including a pair of connection portions and a plurality of rail portions, with the pair of connection portions and the plurality of rail portions being integrally formed with each other, with the pair of connection portions and the plurality of rail portions respectively formed at two opposite sides of each rail member, with the pair of connection portions of each rail member extending along the longitudinal curved lines to correspond to each pair of support legs, with the pair of connection portions of each rail member threadedly connected to each pair of support legs; and a plurality of drawers each slidably mounted between two rail portions of the two rail members facing each other.

10. The assembly storage rack as claimed in claim 9, with each pair of support legs being curved metal cylinders.

11. The assembly storage rack as claimed in claim 9, further comprising:

a pair of support rods threadedly mounted between top ends of the two pair of support legs; and a cap member detachedly mounted on the pair of support rods.

12. The assembly storage rack as claimed in claim 9, with each rail portion having a sliding recess extending therethrough, with each drawer including a pair of guiding portions formed at two opposite thereof, and with the pair of guiding portions of each drawer slidably mounted in two sliding recesses of two rail portions of the two rail members facing each other.

13. An assembly storage rack comprising:

two pair of support legs;

a pair of support rods threadedly mounted between top ends of the two pair of support legs;

two rail members each including a pair of connection portions and a plurality of rail portions, with the pair of connection portions and the plurality of rail portions being integrally formed with each other, with the pair of connection portions and the plurality of rail portions respectively formed at two opposite sides of each rail member, with the pair of connection portions of each rail member detachedly mounted to each pair of support legs; and a plurality of drawers each slidably mounted between two rail portions of the two rail members facing each other.

14. The assembly storage rack as claimed in claim 13, further comprising:

a cap member detachably mounted on the pair of support rods.

* * * * *